US006296143B1

(12) United States Patent
Ghabriel

(10) Patent No.: US 6,296,143 B1
(45) Date of Patent: Oct. 2, 2001

(54) DISPENSING APPARATUS

(76) Inventor: Maged Ghabriel, Lot 12 Spotted Gum Place, Greystanes NSW (AU), 2145

( * ) Notice: Subject to any disclaimer, the term of this patent is extended or adjusted under 35 U.S.C. 154(b) by 0 days.

(21) Appl. No.: 09/598,077

(22) Filed: Jun. 21, 2000

(30) Foreign Application Priority Data

Jun. 22, 1999 (AU) ..... PQ2560

(51) Int. Cl.[7] ..... B65H 1/00

(52) U.S. Cl. ..... 221/34; 221/47; 221/48; 221/63

(58) Field of Search ..... 221/34, 35, 47, 221/48, 63, 33; 206/233, 555

(56) References Cited

U.S. PATENT DOCUMENTS 3,119,516 * 1/1964 Donovan ..... 221/47
5,143,249 9/1992 Criq et al. .
5,622,281 * 4/1997 Annand ..... 221/48

FOREIGN PATENT DOCUMENTS 2 694 878 2/1994 (FR) .
2 336 834 11/1999 (GB) .
WO 95/25668 9/1995 (WO) .

* cited by examiner

*Primary Examiner*—David H. Bollinger
(74) *Attorney, Agent, or Firm*—Timothy J. Keefer; Wildman, Harrold, Allen & Dixon

(57) ABSTRACT

Dispensing apparatus 12 adapted for dispensing interleaved folded paper products 10 and 28 by means of a plurality of conventional dispensing perforations including one such perforation on the top face of a paper products container 14 and at least one other similar such perforation 20 on another face 22 of the container positioned at a point intermediate the height of the face.

3 Claims, 2 Drawing Sheets

DISPENSING APPARATUS

FIELD OF THE INVENTION

The present invention relates to apparatus for dispensing interleaved folded paper products. The invention will primarily be described with reference to its use for dispensing tissues, but it should be remembered that the invention can have broader application to any othor paper products requiring dispensation, such as napkins, paper towel, wipers or other absorbent products.

BACKGROUND ART

Tissues are normally dispensed sequentially from a box of interleaved tissues by means of a conventional dispensing perforation located on the top face of the tissue box or container. As a first tissue is dispensed from such a box of interleaved tissues, a second tissue will be drawn upward by the dispensing action so as to be grasped in the conventional dispensing perforation. The conventional dispensing perforation normally consists of an elliptical or elongated detachable protective tab of any shape made of similar material to the tissue box. The detachable protective tab usually has a taut protective membrane located immediately thereunder which may be manufactured of plastic or other material which has a single longitudinal perforation.

The repetition of the action of replacing the dispensed tissue with a fresh candidate for later dispensation works well when the tissue box is newly opened. The lead flap of the tissue (that portion of the tissue protruding from the tissue box awaiting dispensation) is grasped by the taut protective membrane located within the conventional dispensing perforation leaving the trailing flap of the tissue at least partly interleavingly engaged with the next tissue in the box, so as to draw that next as its replacement.

However as the distance between the top of the tissue box and the top of the pile of interleaved tissues within the box increases as the tissues are consumed, the interleaving engagement of the trailing flap of the fresh tissue with the next tissue becomes less secure. Frequently, dispensation failure occurs and the lead flap of the next tissue falls back into the box without being grasped by the taut protective membrane. This is known as 'fall out' failure or 'loss of flap' wherein the dispensing flap of the tissue is not extended through the dispensing opening so that no lead flap is readily available for grasping by the user for next dispensing. The common remedy for this situation is for hands or fingers to be inserted in through the dispensing perforation and the taut protective membrane to draw the next fresh tissue out of the box. As expected, such an action ultimately causes some damage to the inherent tension of the protective membrane, further reducing its ability to grasp the leading flap of the fresh tissue, leading to increased 'loss of flap' or 'fall out' failure. Multiple dispensing of tissues often occurs at this point to wastage.

Attempts by some tissue box manufactures to reduce the distance between the top of the tissue box and the top of the pile of interleaved tissues within the box by means of depressible elevation tabs located in the bottom of the tissue box designed to raise the pile of interleaved tissues within the box during use, have proven largely unsuccessful since dispensation failure due to damage to the taut protective membrane remains an issue.

SUMMARY OF THE INVENTION

The present invention in a first aspect provides apparatus for dispensing interleaved folded paper products by means of a plurality of dispensing opening including one such perforation on the top face of a paper products container and at least one other similar such perforation on another face of the container positioned at a point immediate the height of the other face.

When the term dispensing opening is used herein it typically refers to a conventional dispensing perforation such as found in tissue boxes or the like, but may also include similar openings in other containers (e.g. for paper towels, wipers, napkins etc).

More preferably the similar other perforation is positioned approximately mid way down said face.

Preferably the other face is a side face of the container.

Preferably the similar other perforation is oriented substantially parallel to the conventional dispensing perforation on the top face.

BRIEF DESCRIPTION OF THE DRAWINGS

Notwithstanding any other forms which may fall within the scope of the present invention, a preferred form of the invention will now be described, by way of example only, with reference to the accompanying drawing in which.

MODES FOR CARRYING OUT THE INVENTION

Figure 1:
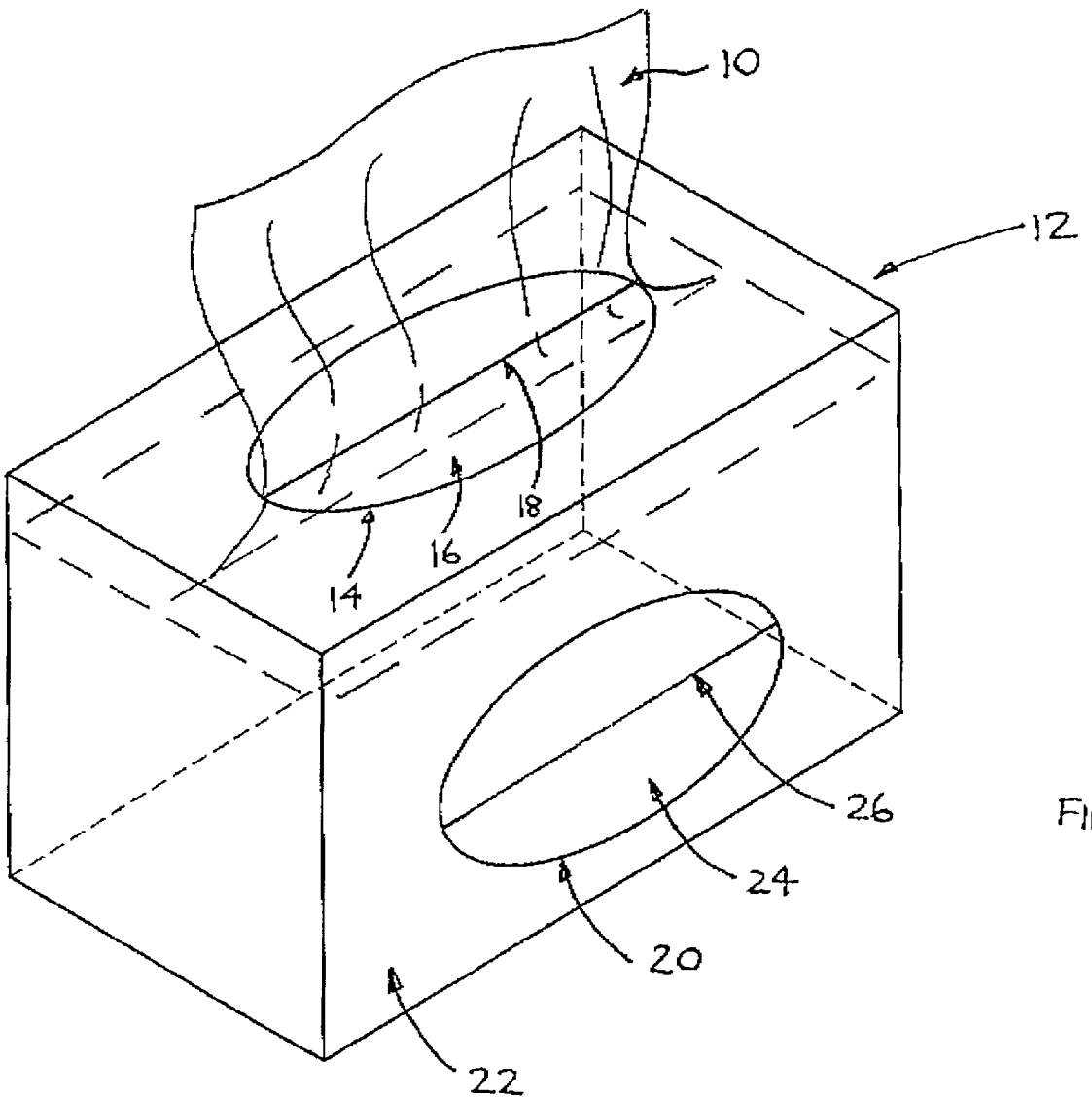
FIG. 1 shows a perspective schematic view of apparatus for dispensing interleaved folded paper products in accordance with the invention.

Referring to FIG. 1, a tissue 10 removed from tissue box 12 by means of an opening in the form of a conventional dispensing perforation 14 located on the top face of the tissue box. A taut protective membrane 16 located across the conventional dispensing perforation 14 features a single longitudinal perforation 18.

In accordance with the present invention, a similar such opening in the form of perforation 20 may be found on one side face 22 of the tissue box 12 containing taut protective membrane 24 located across the conventional dispensing perforation 20 and featuring a single longitudinal perforation 26.

In use, when the box is first opened, tissues are removed in the traditional fashion by means of conventional dispensing perforation 14. Taut protective membrane 16 grasps the leading flap of a next tissue 10 as the tissue passes through longitudinal perforation 18 and supplies sufficient resistance to prevent this tissue from either being withdrawn with the dispensed tissue or falling back into the box without being grasped.

As the distance between the top of the tissue box and the top of the pile of interleaved tissues within the box increases as the tissues are consumed, the interleaving engagement of the trailing flap of the fresh tissue with the next tissue becomes less secure. Frequently, dispensation or 'loss of flap' failure occurs.

Further, the height of the tissue box, and therefore the number of tissues that a tissue box may contain, is limited by tissue width. Since an interleaving engagement of the trailing flap of the fresh tissue with the next tissue is required for a continuous tissue withdrawal process, then it may be understood that if a tissue box is too deep, tissues nearer the bottom of the box would experience 'loss of flap' failure upon every withdrawal, as there would be little or no interleaving engagement possible between consecutive tissues. Naturally this limits the depth of a tissue box to something approaching half the width of a single tissue towel. Very large capacity tissue box are unavailable as a result, even though they would likely provide the greatest consumer economy.

Figure 2:
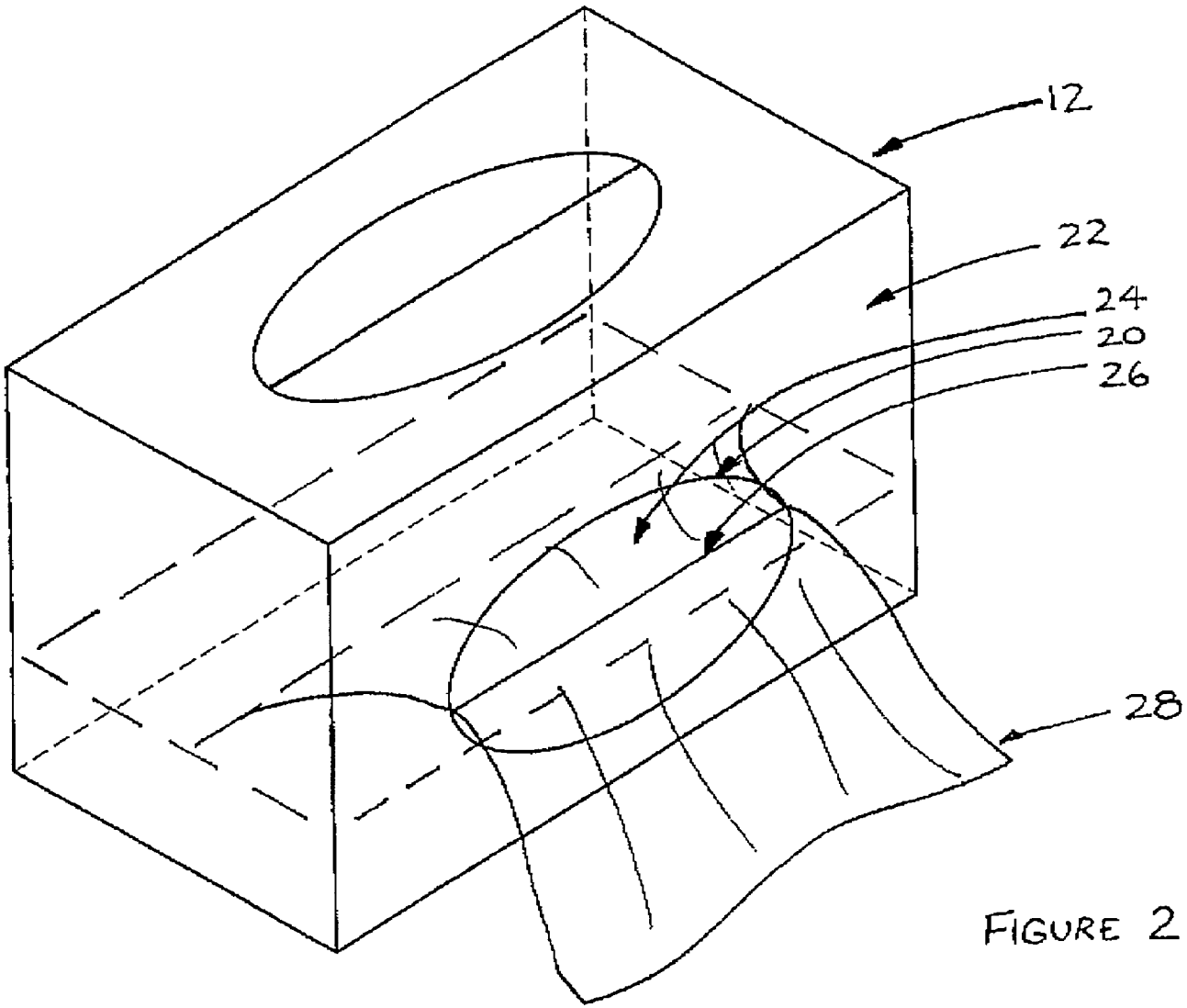
FIG. 2 shows a similar perspective schematic view to FIG. 1 but in a different mode of use.

In accordance with the present invention, when the tissue depth is sufficiently low that 'loss of flap' failure begins to occur, tissues may then be removed in the new manner as illustrated in FIG. 2 by means of the conventional dispensing perforation 20. A first tissue is gently urged into the single longitudinal perforation 26. Taut protective membrane 24 then grasps the leading flap of a next tissue 28 as the tissue passes through longitudinal perforation 20 and supplies sufficient resistance to prevent this tissue from either being withdrawn with the dispensed tissue or falling back into the box without being grasped. Given that now the distance between the top of the tissue box and the top of the pile of interleaved tissue within the box is again very small, the interleaving engagement of the trailing flap of the fresh tissue with the next tissue retains its integrity and, combined with the fact that taut protective membrane 24 also provides a 'rest point' for the lead flap of the fresh tissue to be dispensed, 'loss of flap' failure is reduced.

Since the physical damage to the taut protective membrane 16 is at this stage quite severe, the availability of the new taut protective membrane 24 enables the box to have improved utility for a longer period, consistently reducing 'loss of flap' failure and thereby reducing waste of tissues (multiple dispensing) which can occur subsequently, and allows tissue boxes to be constructed of considerably greater capacity than previously known.

There is no particular preferred location or orientation of conventional dispensing perforation 20 although such a perforation could be positioned at an intermediate point, perhaps mid way down side face 22. The perforation 14 and 20 and the longitudinal membrane perforations 18 and 26 are illustrated as being substantially parallel to each other, although this may not necessarily be the case. Also, further dispensing perforations could be provided, such as at ends of the box, or on the face opposite face 22, or even in the underside of the box 12. In this latter case, however an internal partition (eg half way down) could be provided so that perhaps half the tissues are on one side and half on the other side of the partition.

Previously it has not been appreciated that a second dispensing mechanism could be implaced on another face of a tissue box to reduce wastage and to allow for greater capacity tissue box containers.

What is claimed is:

1. A container adapted for dispensing interleaved folded paper products, the container comprised of:

a top face parallel to the paper products;

a first opening contained within the top face of the container, the top face being separated from a bottom face by a first distance; and at least one other opening on a second face of the container perpendicular to the top face, the other opening positioned at a point intermediate the first distance.

2. The dispensing apparatus as claimed in claim 1 wherein the other similar such opening is positioned approximately mid way down the other face.

3. The dispensing apparatus as claimed in claim 2 wherein the other face is a side face of the container.

* * * * *